United States Patent [19]

Bianchetta et al.

[11] 4,286,502

[45] Sep. 1, 1981

[54] HYDRAULIC LOAD LIFTING SYSTEM WITH AUTOMATIC BLOCKING VALVE

[75] Inventors: Donald L. Bianchetta, Coal City; Edward A. Wirtz, Joliet, both of Ill.

[73] Assignee: Caterpillar Tractor Co., Peoria, Ill.

[21] Appl. No.: 118,037

[22] PCT Filed: Oct. 15, 1979

[86] PCT No.: PCT/79/00859

§ 371 Date: Oct. 15, 1979

§ 102(e) Date: Oct. 15, 1979

[87] PCT Pub. No.: WO81/01034

PCT Pub. Date: Apr. 16, 1981

[51] Int. Cl.[3] ..... F15B 13/042

[52] U.S. Cl. ..... 91/445; 91/461

[58] Field of Search ..... 91/420, 445, 461; 137/489, 491

[56] References Cited

U.S. PATENT DOCUMENTS

| | | | |
|---|---|---|---|
| 2,860,607 | 11/1958 | Orloff | 91/445 |
| 2,964,016 | 12/1960 | Talak . | |
| 3,795,255 | 3/1974 | Malott et al. | 91/420 X |
| 4,000,683 | 1/1977 | Schexnayder | 91/445 X |
| 4,004,607 | 1/1977 | Freese | 137/486 |
| 4,006,667 | 2/1977 | Bianchetta et al. | 91/445 |
| 4,063,489 | 12/1977 | Parquet et al. | 91/445 |

*Primary Examiner*—Irwin C. Cohen

*Attorney, Agent, or Firm*—Phillips, Moore, Weissenberger, Lempio & Majestic

[57] ABSTRACT

In prior art hydraulic systems, and in particular in hydraulic systems having a cylinder means for elevating and lowering a load, there exists the possibility that the hydraulic line from a control valve to the cylinder means could rupture, allowing the load to drop before the operator could react. The present invention solves this problem by providing a blocker valve (100) in the vent line (69) of a check valve (33,34) which check valve is interposed in the main line 27 between a cylinder means (12) and a control valve (21). The blocker valve (100) is responsive to the back pressure in the main line (27) from the check valve (33,34) to the control valve (27). Thus, when the pressure in said main line (27) drops below a predetermined level due, for example, to a break in said line (27) the blocker valve (100) automatically closes the vent line (69), preventing the check valve (33,34) from releasing hydraulic fluid, and thus preventing the load (14) from dropping. In an aspect of the invention, a resolver valve (104) actuates the blocker valve (100). The resolver valve (104) communicates with the main line (27) at two positions and selects the lowest pressure between said positions.

7 Claims, 1 Drawing Figure

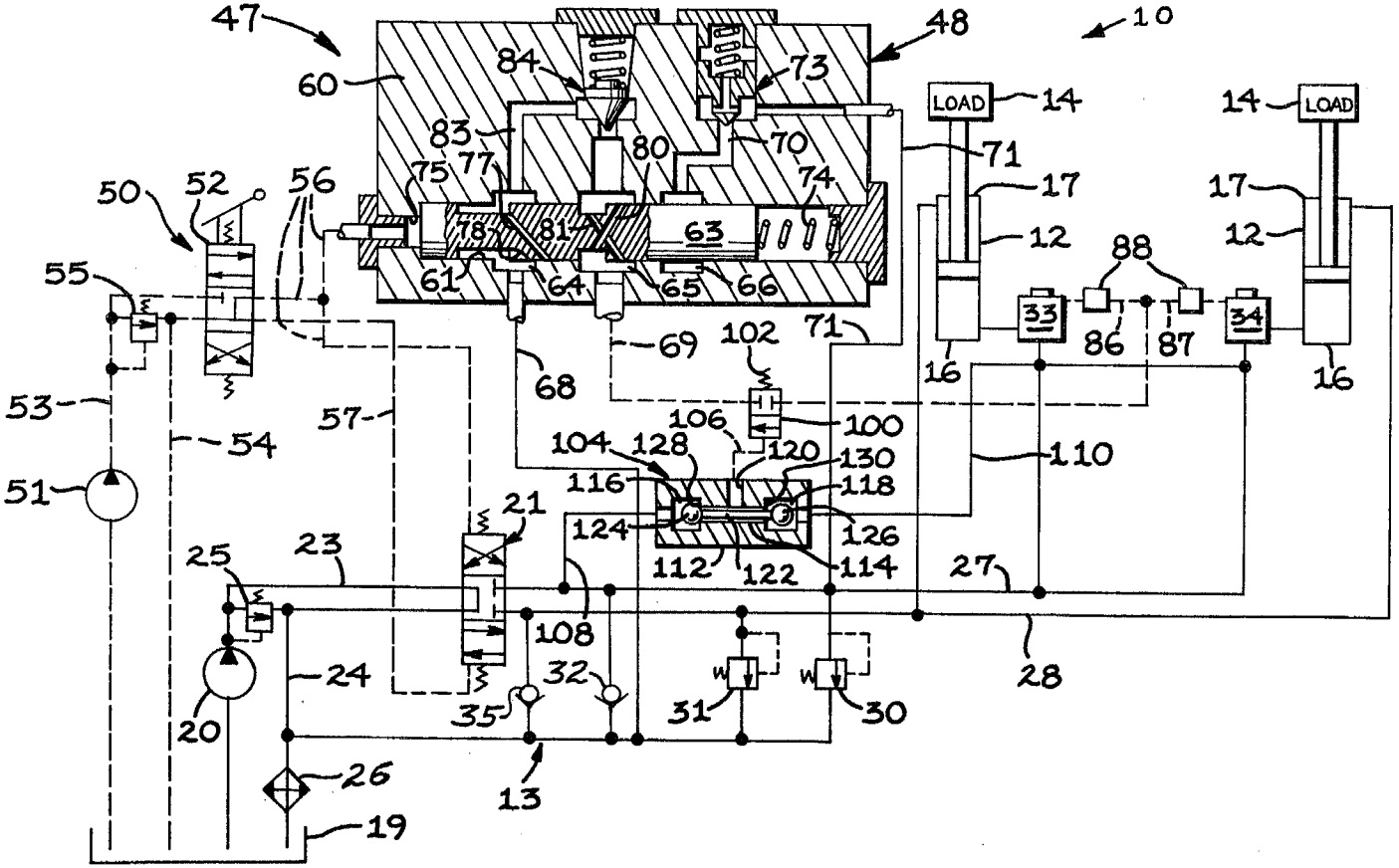
LOAD
LOAD
10
47
48
60
61
63
64
65
66
68
69
70
71
73
74
75
77
78
80
81
83
84
100
102
104
106
108
110
112
114
116
118
120
122
124
126
128
130
12
13
14
16
17
19
20
21
23
24
25
26
27
28
30
31
32
33
34
35
50
51
52
53
54
55
56
57
86
87
88

HYDRAULIC LOAD LIFTING SYSTEM WITH AUTOMATIC BLOCKING VALVE

DESCRIPTION

TECHNICAL FIELD

The present invention relates to a hydraulic load lifting system and, in particular, to a system including a hydraulic cylinder and means for preventing a load carried by said cylinders from moving should a leak occur in the hydraulic line to the cylinder.

BACKGROUND ART

Hydraulic systems, such as those found in excavators and the like, employ a hydraulic cylinder to raise and lower relatively heavy loads and at times to support such loads in an elevated position. When the cylinder is required to support the load in such an elevated position, it is normally desirable to isolate the relatively high load generated pressure in the load supporting end of the cylinder from the remainder of the system. This is to prevent the downward drifting of the load due to leakage past a valve spool of a conventional control valve normally used in such systems. The load pressure is also normally isolated to prevent the sudden dropping of the load in the event of a hydraulic line failure or the like.

This isolation can be accomplished by the positioning of a load check valve in the hydraulic line leading from the control valve to the hydraulic cylinder. Such a load check valve permits the free flow of fluid to the cylinder, but normally prevents the escape of fluid from the cylinder. The load check valve can be of the type which is vented behind the check valve spool, such that the check valve closes the hydraulic line when the venting line is blocked. When the venting line is opened, hydraulic fluid can flow from the cylinder to the control valve and from the control valve to the cylinder. The load check valve can be mounted directly to the hydraulic cylinder eliminating the need for a conduit to connect the cylinder to the check valve and thus eliminating the possibility of a break therein.

However, there is always a possibility that a rupture might occur in the hydraulic line which connects the load check valve to the control valve. If such a rupture occurs and if the venting line from the load check valve is not closed, the load can fall until the operator of the hydraulic system realizes that the load is falling and acts to block the vent line, preventing the load from dropping still further.

DISCLOSURE OF THE INVENTION

The present invention is directed to overcoming one or more of the problems as set forth above.

In a hydrauluc system comprising a check valve having a main line and a vent line, the improvement includes a blocker means for closing said vent line when the pressure in said main line falls below a predetermined level. Accordingly, should a break in the main line between the load check valve and the control valve occur, back pressure in said line would fall. The blocker means can sense this reduction in pressure and can automatically close the vent line preventing the check valve from allowing hydraulic fluid to flow from the cylinder. Thus, the system automatically prevents the load from falling without the operator being required to sense the falling load and then act to close the vent line.

In another aspect of the invention, the blocker means includes a blocker valve positioned in the vent line, the blocker valve actuated by a resolver means which selects the lowest pressure in the main line between two sensed positions in said main line. Thus, if a break occured in one portion of the main line, the resolver means will immediately select the lower main line pressure occuring adjacent the break and communicate said pressure to the blocker valve of the main line to shut the vent line, preventing the load from falling.

BRIEF DESCRIPTION OF THE DRAWINGS

The FIGURE shows an overall schematic circuit diagram of a hydraulic load lifting system which includes a blocker valve and a sectioned resolver valve embodiment of the present invention.

BEST MODE OF CARRYING OUT THE INVENTION

The hydraulic load lifting system of the FIGURE, except for the aforementioned blocker valve and the resolver valve, is described in U.S. Pat. No. 4,000,683 issued on Jan. 4, 1977 to Lawrence F. Schexnayder. For purposes of brevity, only the main features of the hydraulic system are discussed hereinbelow.

Following the numbering of the above referenced patent, the hydraulic load lifting system 10 generally includes load supporting hydraulic motor means, such as a pair of hydraulic jacks 12 and a control circuit 13 operatively connected to control the extension of such jacks 12 for raising a load 14 and the retraction thereof for lowering the load 14. The jacks each include a load supported or head end 16 and an opposite rod end 17.

The control circuit 13 includes a fluid reservoir 19, a main pump 20 connected for drawing fluid from the reservoir 19 and a pilot-operated main control valve 21. A pump line 23 connects pump 20 to the control valve 21. The control valve 21 is selectively positioned between the depicted neutral or a hold position and either of two other operative positions. The control valve 21 communicates with the reservoir 19 by way of a tank line 24 and a cooler 26. A relief valve 25 selectively controls communication between the pump line 23 and the tank line 24 to limit the maximum pressure in the control circuit between the pump 20 and the control valve 21. The control valve 21 is further connected to the head end 16 and the opposite rod end 17 of the jacks 12 by main control lines 27 and 28, respectively. A pair of main line relief valves 30 and 31 are connected to main control lines 27 and 28, respectively, to limit the maximum pressure in the control circuit on the hydraulic jack side of the control valve. Make up valves 32 and 35 are also connected to main control lines 27 and 28, respectively, and to tank line 24 to provide fluid to the lines 27 and 28 whenever pressure in either of the lines fall below a predetermined level. This is accomplished as pump line 23 is connected to tank line 24 with main control valve 21 in the neutral position and as cooler 26 provides back pressure in the tank line 24 by restricting the flow therefrom to tank 19.

A pair of identical, vented load check valves 33 and 34 are disposed within the main motor line 27 to each of the head ends 16 of the hydraulic jacks 12. The purpose of such load check valves, as will be apparent to those skilled in the art, is to avoid downward drifting of the load due to leakage through the main control valve 21 and to prevent the sudden dropping of the load in the event of a line failure or the like. For this reason, the load check valves are preferably disposed on their respective jacks. While the schematic drawing in FIGURE shows such valves as being somewhat spaced from jacks 12, they are preferably mounted directly on their respective jacks or integral therewith to alleviate the possibility of a line failure between the jacks and the load check valve.

The control circuit 13 is provided with venting apparatus generally indicated at 47 for selectively venting the load check valves 33,34. The apparatus 47 includes a pilot operated venting valve 48.

A pilot controlled system, indicated generally at 50, is provided for selectively simultaneously controlling the operation of the main control valve 21 and the venting valve 48. The pilot system includes a pilot pump 51, connected for drawing fluid from the reservoir 19, for supplying fluid to the pilot control valve 52 by a line 53. The pilot control valve 52 communicates with the reservoir through a second line 54. A relief valve 55 is disposed between lines 53 and 54 to limit the maximum pressure in the pilot system to a predetermined level. The pilot control valve is further communicated with the opposite ends of the main control valve 21 by way of pilot lines 56 and 57. The pilot line 56 is also connected to the venting valve 48 to communicate pilot fluid thereto when pilot pressure is directed to the control valve 21 to shift the control valve to the jack lowering position. As is evident from the FIGURE, pilot lines of the pilot pressure system are represented by dash lines.

The pilot operated venting valve 48 is connected to the load check valves 33 amd 34 by way of a vent line 69. The valve 48 is also connected to the main control line 27 by a connector line 71. Further, a tank line 68 communicates the valve 48 with the tank 19.

The preferred construction of the venting apparatus 47 includes a valve body 60 having a valve bore 61 therein for reciprocally mounting a valve spool 63. The bore is provided with three axially spaced annuli 64,65 and 66. The first annulus 64 is connected to the reservoir 19 by way of the tank line 68. The second annulus 65 is connected to the load check valves 33 and 34 by way of vent line 69. The third annulus 66 is connected by way of passage 70 in the valve body and connector line 71 to the main control line 27 connected to the head end 16 of the jack 12. A check valve 73 is disposed within the passage 70 for freely admitting fluid to the connector line 71 but preventing flow in the opposite direction.

The valve spool is normally biased to a first or vertical position, depicted in the FIGURE, by a spring 74. The valve body 60 has a pilot inlet port 75 which is connected to the pilot line 56 for communicating pilot pressure against one end of the valve spool to shift the spool toward the right. The valve spool 63 is provided with passage means including an angular passage 77 and a metering slot 78 for interconnecting the second annulus 65 with the first annulus 64 to permit the venting of the load check valves 33 and 34 to allow their opening. However, the valve spool is also provided with an intermediate position between the neutral and fully actuated position. The valve spool is provided with passage means including a pair of staggered angularly disposed passages 80 and 81 for interconnecting the second and third annuli when the spool is in its intermediate position. Thus the fluid pressure in the vent line 69 is communicated to the main control line 27 through the connector line 71 and the passage 70.

The venting valve 48 is also provided with a passage 83 interconnecting the first and second annuli which passage is provided with a relief valve 84 and is designed to open at a pressure somewhat lower than the opening pressure of the main line relief valve 30.

The venting line 69 is provided with a pair of branch lines 86 and 87 for individually connecting the vent line with the load check valves 33 and 34, respectively. Each branch line is provided with a choke and check device 88. Each device 88 allows fluid to flow from the respective load check valve, but includes means for partially restricting the flow in the opposite direction.

The present invention includes the incorporation of a blocker valve 100 in the vent line 69. The blocker valve 100 has a closed position (depicted in the FIGURE) and an open position and is normally biased by a lightweight spring 102 to the closed position, preventing fluid from flowing in vent line 69. In a preferred embodiment blocker valve 100 is in fluid communication with and actuated by the fluid from a low pressure resolver valve 104 through conduit 106. Resolver valve 104 communicates with main control line 27 through conduit 108 at a point adjacent to the pilot operated main control valve 21 and through conduit 110 at points adjacent the vented load check valves 33 and 34. Lines 27 and 28 would always have same fluid pressure in them during normal operation due to the aforementioned back pressure in line 24 as a result of fluid flowing through cooler 26. This back pressure will be transferred to line 27 and 28 through make up valves 32 and 35. Further it is to be appreciated that absent cooler 26 and make up valves 32 and 35, there would still be back pressure in lines 27 and 28.

The low pressure resolver valve 104 includes a valve housing 112 which defines a central bore 114 having a first enlarged chamber 116 and a second enlarged chamber 118. As can be seen in the FIGURE, conduit 108 is provided in communication with central bore 114 adjacent to first enlarged chamber 116 and conduit 110 is provided in fluid communication with central bore 114 adjacent to second enlarged chamber 118. An internal bore 120 provides fluid communication between a portion of central bore 114 intermediate first and second enlarged chambers 116 and 118 and conduit 106 which is provided in fluid communication with blocker valve 100.

Disposed in central bore 114 is a slidable spool 122. Slidable spool 122 defines first spherical end 124 and second spherical end 126. First spherical end 124 is restrainingly contained in first enlarge chamber 116 and second spherical end 126 is restrainingly contained in second enlarge chamber 118.

If the pressure in the conduit 108 is higher than the pressure in conduit 110, first spherical end 124 is urged against the internal wall 128 of first enlarged chamber 116, preventing any fluid from conduit 108 from flowing through central bore 114 to conduit 106. Concurrently, due to the length of slidable spool 122, the second spherical end 126 is positioned substantially in the middle of second enlarged chamber 118 such that the lower pressure fluid in conduit 110 can flow through central bore 114 to conduit 106. The above described position is depicted in the FIGURE. Should the pressure in line 110 be below the predetermined level, owing to a break in conduit 27 adjacent the check valves 33 and 34, blocker valve 100 would automatically close due to reduced pressure in conduit 106 preventing the relief of pressure from said check valves 33 and 34 and thus preventing the load 14 from falling. Conversely, if the pressure in conduit 108 is less than the pressure in conduit 110, the second spherical end 126 will be urged against the internal wall 130 of the second enlarged chamber 118 blocking fluid communication from conduit 110 through central bore 114 end to conduit 106. Again the slidable spool 122 is of such a length that with the second spherical end 126 positioned against the internal wall 130 of the second enlarged chamber 118, the first spherical end 124 is positioned in the middle of the first enlarged chamber 116 such that fluid communication is provided from conduit 108 through the central bore 114 to conduit 106. Again, if the hydraulic pressure in main control line 27 drops below a predetermined level, owing to a break in main control line 27 adjacent control valve 21, the fluid pressure in line 108 would be insufficient to keep the spring 102 from closing the blocker valve 100, and thereby closing the vent line, preventing the load from falling.

It is to be understood that alternatively the low pressure resolver valve 104 can be eliminated from the hydraulic system and the blocker 110 can be connected directly to the main control line 27 by conduit 106. In such case the blocker valve 100 would be actuated to an open position by the pressure at one point on main control line 27 instead of being actuated by the lowest of two pressures at two different points on main control line 27.

Industrial Applicability

The overall operation of the hydraulic load lifting system is discussed in U.S. Pat. No. 4,000,683, discussed above and incorporated herein by reference. The operation of the improvement is as follows:

With, for example, the pilot control valve 52 in the appropriate position for allowing the jack 12 to lower the load 14, venting valve 48 opens venting line 69 so that fluid can be vented behind load check valves 33 and 34 thereby allowing the fluid from the head ends 16 of the jacks 12 to flow through the main control line 27. As long as the return flow pressure in main control line 27 is at or above the normal operating level at the points where the conduit 108 and 110 communicate with said main control line, the resolver valve 104 will select the lowest of the pressures at the points and communicate that pressure to blocker valve 100. Valve 100 will be urged to an open position, keeping vent line 69 open so that the lowering of load 14 can continue as fluid is vented behind check valves 33 and 34. If a break should occur in the main control line 27 so that the pressure at the intersection of either conduit 108 and main control line 27 or conduit 110 and main control line 27 is below the normal operating level, the lower pressure will be selected by low pressure resolver valve 104 and communicated through conduit 106 to blocker valve 100. The lower pressure will be unable to overcome the spring 102, and thus spring 102 will urge the blocker valve to the closed mode, preventing fluid from flowing through venting line 69 from the load check valves 33 and 34. This will quickly cause load check valves 33 and 34 to close, thus preventing fluid from flowing from the jacks 12 through said load check valves 33 and 34 to the main control line 27.

As is obvious from the above description, the blocker valve and resolver valve 104 function automatically should a rupture occur in the main control line 27. Accordingly, for example, without the operator having to realize that the load 14 is descending at a higher rate than that selected, and in fact, before the rate of descent is noticably different from that selected, the resolver 104 and blocker valve 100 have prevented fluid from flowing in vent line 69 and thus the load from falling. In a prior device, upon seeing the load falling, the operator would have to immediately shift a pilot control, such as pilot control valve 52, to a blocking position to prevent fluid from venting behind the load check valve 33 and 34.

Further as the blocker valve 100 overrides the pilot control system 50, the operator cannot inadvertently restart the jacks 12 in motion until the break in the main control line 27 is repaired and normal operating pressure is restored.

It is to be understood that if desired a blocker valve (not shown) and a resolver valve (not shown) similar to valves 100 and 104 and with appropriate load check valves (not shown) could be incorporated into main control line 28 to prevent a load from falling should the jacks 12 be inverted.

Other aspects, objects, and advantages of this invention can be obtained from a study of the drawing, the disclosure, and the appended claims.

We claim:

1. In a hydraulic system (10) having a cylinder (12), a check valve means (33) for selectively checking hydraulic fluid flow in a main line (27) to the cylinder (12), wherein hydraulic pressure from said cylinder (12) acts behind said check valve means (33) to close said check valve means (33), and a vent line means (69) for selectively venting behind said check valve means (33) to allow said check valve means (33) to open, the improvement comprising a pressure responsive blocker means (100,104) for closing said vent line means (69) when the pressure in said main line (27) falls below a predetermined level.

2. In the hydraulic system (10) of claim 1, the improvement further comprising said blocker means (100,104) including a blocker valve (100) positioned in said vent line means (69) and a resolver means (104) for selecting the lowest pressure in the main line (27) between two sensed positions in said main line (27), and means (106) for making said blocker valve (100) responsive to the lowest pressure selected by said resolver means (104).

3. In the hydraulic system (10) of claim 1, wherein said system (10) includes vent valve means (47) in fluid communication with said vent line means (69) for venting behind said check valve (33,34).

4. In the hydraulic system (10) of claim 1 wherein said system (10) includes said check valve means (33) mounted directly on said cylinder (12).

5. In the hydraulic system (10) of claim 2 including a control valve means (21) for selectively communicating fluid to and releasing fluid from said main line 27, the improvement including the resolver means (104) selecting the lowest pressure in the main line (27) between the check valve means (33) and the control valve means (21).

6. In the hydraulic system (10) of claim 1 wherein said blocker means (100,104) includes a blocker valve (100) which has means (102) for urging said blocker valve (100) to a normal closed position.

7. In the hydraulic system (10) of claim 1 wherein the improvement comprising said blocker means (100,104) including a blocker valve (100) having an open position and a closed position, and means (102) for urging said blocker valve (100) to the closed position, and means (106) for urging said blocker valve (100) to said open position responsive to pressure in said main line (27).

* * * * *